US011097817B2

(12) United States Patent
Darroch

(10) Patent No.: US 11,097,817 B2
(45) Date of Patent: Aug. 24, 2021

(54) MARKER, RECOVERY AND FLOTATION DEVICE

(71) Applicant: SEEARCH INC., Toronto (CA)

(72) Inventor: Neil John Darroch, Burlington (CA)

(73) Assignee: SEEARCH INC., Toronto (CA)

( * ) Notice: Subject to any disclaimer, the term of this patent is extended or adjusted under 35 U.S.C. 154(b) by 58 days.

(21) Appl. No.: 16/498,821

(22) PCT Filed: Mar. 29, 2018

(86) PCT No.: PCT/CA2018/050387

§ 371 (c)(1),
(2) Date: Sep. 27, 2019

(87) PCT Pub. No.: WO2018/176148

PCT Pub. Date: Oct. 4, 2018

(65) Prior Publication Data

US 2021/0086878 A1 Mar. 25, 2021

Related U.S. Application Data

(60) Provisional application No. 62/480,133, filed on Mar. 31, 2017.

(51) Int. Cl.
*B63C 9/08* (2006.01)
*B63C 9/125* (2006.01)
(Continued)

(52) U.S. Cl.
CPC ..... *B63C 9/081* (2013.01); *B63C 9/1255* (2013.01); *B63C 9/155* (2013.01); *B63C 9/18* (2013.01); *B63C 9/22* (2013.01)

(58) Field of Classification Search
CPC ..... B63C 9/00; B63C 9/081; B63C 9/125; B63C 9/1255; B63C 9/15; B63C 9/155;
(Continued)

(56) References Cited

U.S. PATENT DOCUMENTS 3,638,258 A 2/1972 Black
3,877,096 A 4/1975 Scesney
(Continued)

FOREIGN PATENT DOCUMENTS

GB 2254296 A 10/1992
KR 20140007536 A 1/2014
WO 9941143 A1 8/1999

OTHER PUBLICATIONS

International Searching Authority, International Search Report dated Jun. 14, 2018, for International application No. PCT/CA2018/050387.

(Continued)

*Primary Examiner* — Lars A Olson
(74) *Attorney, Agent, or Firm* — Moffat & Co

(57) ABSTRACT

A marker and recovery device comprising: an enclosure adapted to be secured to a wearer; a bladder configured to fit within the enclosure in an uninflated state, the bladder comprising: an elongate tube; a first upper tube fluidly connected to the elongate tube at a first end of the elongate tube; and a second upper tube fluidly connected to the elongate tube at a second end of the elongate tube; and an inflation mechanism to inflate the bladder to extend the bladder from the uninflated state to a deployed state in which the first upper tube and second upper tube join to form a handle portion at the end of the elongate tube.

17 Claims, 7 Drawing Sheets

(51) Int. Cl.

| | |
|---|---|
| ***B63C 9/15*** | (2006.01) |
| ***B63C 9/18*** | (2006.01) |
| ***B63C 9/22*** | (2006.01) |

(58) Field of Classification Search

CPC .. B63C 9/18; B63C 9/22; B63B 35/00; B63B 35/78

USPC ..... 441/90, 96

See application file for complete search history.

(56) References Cited

U.S. PATENT DOCUMENTS

| | | | | |
|---|---|---|---|---|
| 5,800,227 | A | 9/1998 | Brown, Jr. | |
| 5,820,431 | A | 10/1998 | Biesecker | |
| 6,036,562 | A | 3/2000 | Brown | |
| 8,920,205 | B2 * | 12/2014 | McCarthy | B63C 9/081 441/93 |
| 10,099,756 | B2 * | 10/2018 | Darroch | B63C 9/1255 |
| 2016/0167751 | A1 | 6/2016 | Darroch | |

OTHER PUBLICATIONS

Canadian Patent Office, Office Action for Application No. 3,058,206, dated Dec. 9, 2020.

European Patent Office, Office Action for Application No. 3,601,035, dated Dec. 17, 2020.

Chinese Office Action, Chinese Application No. 201880023487.1, Action dated May 20, 2021.

* cited by examiner

MARKER, RECOVERY AND FLOTATION DEVICE

FIELD OF THE DISCLOSURE

The present disclosure relates to a personal marker, recovery, and flotation device for waterborne activities.

BACKGROUND

When engaged in waterborne activities, such as boating, there is a constant risk of unintentionally falling into the water and being separated from the vessel. To mitigate the risk of drowning, personal flotation devices (PFDs), otherwise known as life jackets, are in widespread use and are responsible for saving countless lives from drowning. The PFDs come in many different configurations but essentially all provide a vest-like structure that fits over the upper torso. The vest is secured by a harness, in the simplest form tie straps, so that the vest is retained on the upper torso. The vest is buoyant and is effective to maintain the user afloat and face-up in water.

The vest may be naturally buoyant, such as when made with a closed-cell foam, or may be inflatable to achieve the requisite buoyancy. Inflation may come from a small pressurized gas cylinder and/or a manual inflation valve. When properly utilized, the vest is capable of supporting the user and maintaining them afloat in a stable condition indefinitely.

However, although the PFD supports the user, the prompt recovery of the user is important due to the exposure to adverse conditions, such as the water temperature and loss of body heat.

Whilst the vests are made from a high visibility material, such as a day glow orange or other fluorescent material, the rescue of the user does depend upon the user being visually locatable. In even a relatively small body of calm water, the user may not be readily discernable from the general surrounding environment, and, if the user is unconscious, is not able to attract attention to rescuers through waving and/or shouting. This problem is exacerbated when there is any degree of wave motion and spotting an individual from an aircraft is extremely difficult.

Additionally, while the PFD keeps the user's head out of flat water, the user is still floating low in the water and the user's head can become completely submerged in waves. This can become a serious problem if the user is in the water for an extended amount of time.

Various proposals have been made to enhance the visibility to facilitate rescue.

U.S. Pat. No. 5,800,227 shows a PFD with a folded marker device on the back of the PFD. The marker device may be released. This device however is relatively bulky.

U.S. Pat. No. 3,638,258 discloses a PFD in which an elongate bar is attached to the PFD. The bar may be inflated so that a wand is provided that enhances visibility. The wand however does nothing to raise the user's face further above the flat water level.

SUMMARY

According to the present disclosure a marker, flotation, and recovery device includes an open or enclosed means of containment, including but not limited to, a pouch, tube, or other similar means of containment to be secured to a user. A deployable bladder is contained in a stored position at the place of containment. The bladder is extendable from a stored condition to a deployed condition in which the bladder may be unconnected to the user, or connected by one or more tethers or other means of connection to the user.

The bladder forms a closed figure.

BRIEF DESCRIPTION OF THE DRAWINGS

Embodiments of the invention will now be described by way of example only with reference to the accompanying drawings in which.

DETAILED DESCRIPTION

The present disclosure provides a marker and recovery device comprising: an enclosure secured to a wearer; a bladder configured to fit within the enclosure in an uninflated state, the bladder comprising: an elongate tube; a first upper tube fluidly connected to the elongate tube at a distal end of the elongate tube; and a second upper tube fluidly connected to the elongate tube at the other distal end of the elongate tube; and an inflation mechanism to inflate the bladder to extend the bladder from the uninflated state to a deployed state in which the first upper tube and second upper tube join to form a handle portion at the end of the elongate tube.

Figure 1:
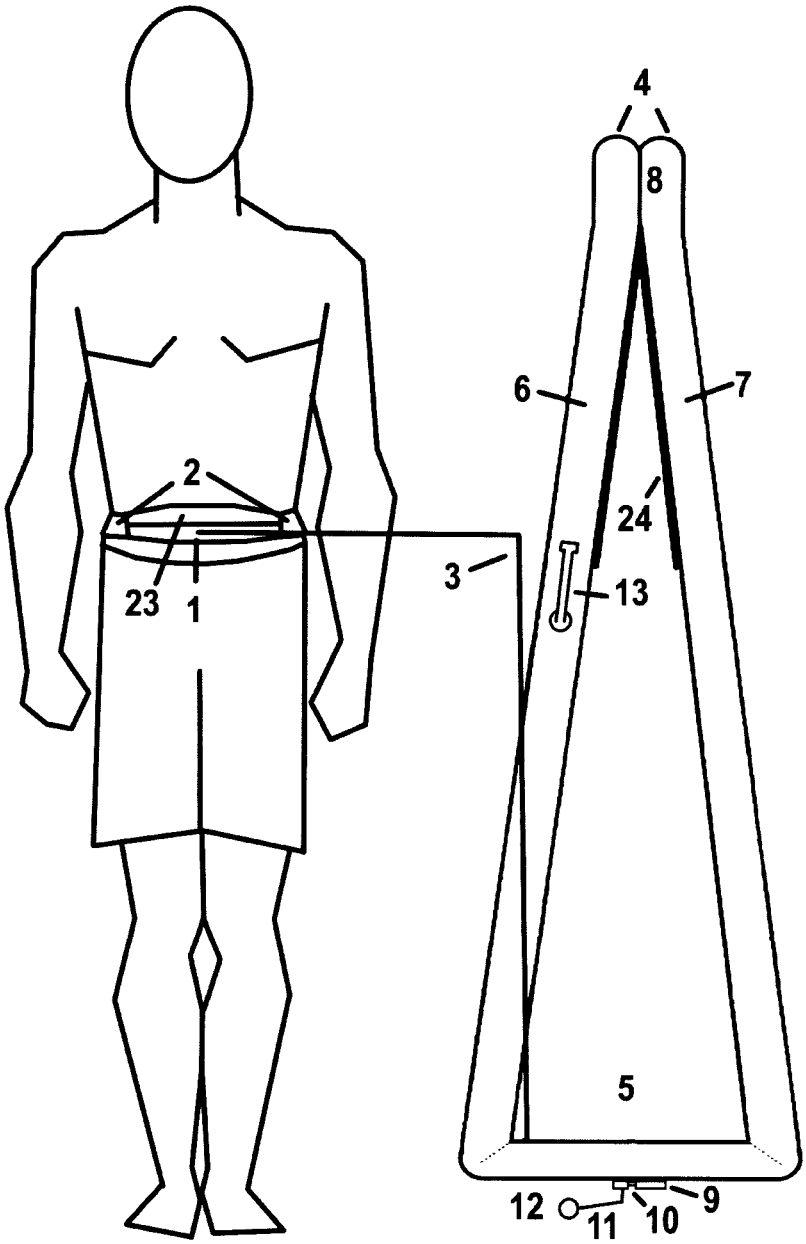
FIG. 1 is a front elevation of the marker, recovery, and flotation device in a deployed condition attached to the user with a tether.

Reference is now made to the drawings, in which similar reference numerals are provided between the drawings. Referring therefore to FIG. 1, a marker, recovery, and flotation device has a means of containment or an enclosure 1 worn by the user. It will be appreciated that the marker and recovery device will be sized according to the typical dimensions of a user and may take many different forms depending on the intended application and the severity of the environment in which the marker and recovery device is to be utilized.

In the embodiment illustrated in FIG. 1, the enclosure 1 is secured to a belt 2 that passes about the torso of the user. The belt 2 may be buoyant to provide some enhanced buoyancy for the user, or may be a simple non-buoyant belt, or may contain an inflatable bladder 30 itself, using a separate inflation mechanism 29.

A deployable bladder 4, comprising a deployable elongate tube 5 which connects at a first end to a first upper tube 6 and at a second end to a second upper tube 7, and is attached to the enclosure 1 with a connecting link 3.

In one embodiment, the first upper tube 6 and the second upper tube 7 are linked to form a closed loop.

In other embodiments, the first upper tube 6 and the second upper tube 7 may be separated from the elongate tube 5 by impermeable barriers 27 and 28 and have inflation system 25 for the first upper tube 6, and inflation system 26 for the second upper tube 7. The location of impermeable barriers 27 and 28 are merely provided for illustration in the embodiment of FIG. 5, and the number and location of such barriers could vary based on various criteria.

The link 8 between the top of the first upper tube 6 and the top of the second upper tube 7 can be a direct joining of the first and second upper tubes 6 and 7, or the link 8 can be a separate link between the top portions of the first and second upper tubes 6 and 7. The separate link can be composed of the same material as that of the deployable tubes, or it can be composed of some other material such as webbing, cord or netting.

In one embodiment, link 8 may be a direct link and allow a fluid connection between the deployment tubes.

In other embodiments, a link 8 may be a combination link. For example, a direct connection may exist between the second upper tube 7 and first upper tube 6, and further webbing 24 may optionally be located directly below this direct connection to provide reinforcement, for example for a rescue situation in which the user is lifted using the connection.

Webbing may also be attached to any portion of the bladder 4.

Figure 5:
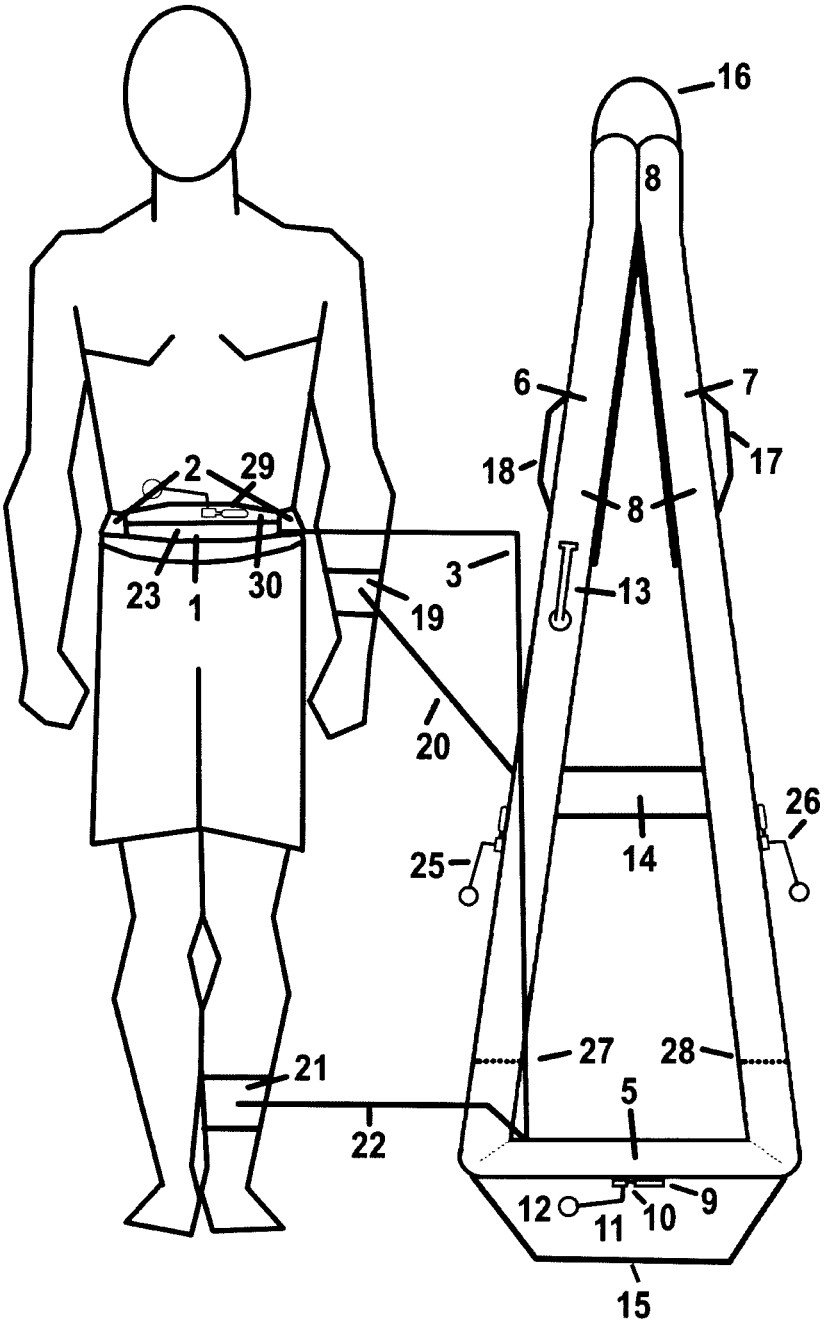
FIG. 5 is a front elevation of the marker, recovery, and flotation device in a deployed condition, with links between the left and right tubes and handles on the left and right tubes.

It will also be appreciated that one or more additional links of any material between first and second upper tubes 6 and 7 can be optionally placed at any location along, above or below the upper tubes 6 and 7. This enhances recoverability by preventing the bladder from slipping loose from the user when the bladder is being hoisted out of the water For example, as can be seen in FIG. 5, one or more additional links can be located between first and second upper tubes 6 and 7 and above elongate tube 5, as with link 14, or located below elongate tube 5, as with link 15, or located above first and second upper tubes 6 and 7, as with link 16.

Additional links 14, 15 or 16 can be adjustable or include a buckle in some cases.

Other examples of a connection between the first and second upper tubes 6 and 7 are also possible.

In the embodiment illustrated in FIG. 1, the deployable bladder 4 is deployed using expanding pressurized gas released from a cylinder 9 or using oral inflation. Deploying bladder 4 causes an inflation mechanism to inflate the bladder to extend the bladder from the uninflated state to a deployed state in which the first upper tube and second upper tube join to form a handle portion at the end of the elongate tube.

It will be appreciated that the enclosure 1 can also attach to a personal flotation device or to a harness or other device worn by the user instead of to the belt 2. The enclosure 1 can be attached to any type of clothing or survival suit such as a floater suit, or may be attached to a belt, strap, wristband, armband, leg band, or other similar attachment mechanism.

It will also be appreciated that the enclosure 1 can also attach to the user at any location, such as a wrist, leg or arm. The enclosure 1 can also be attached to the user's legs by means of leg straps.

Figure 4:
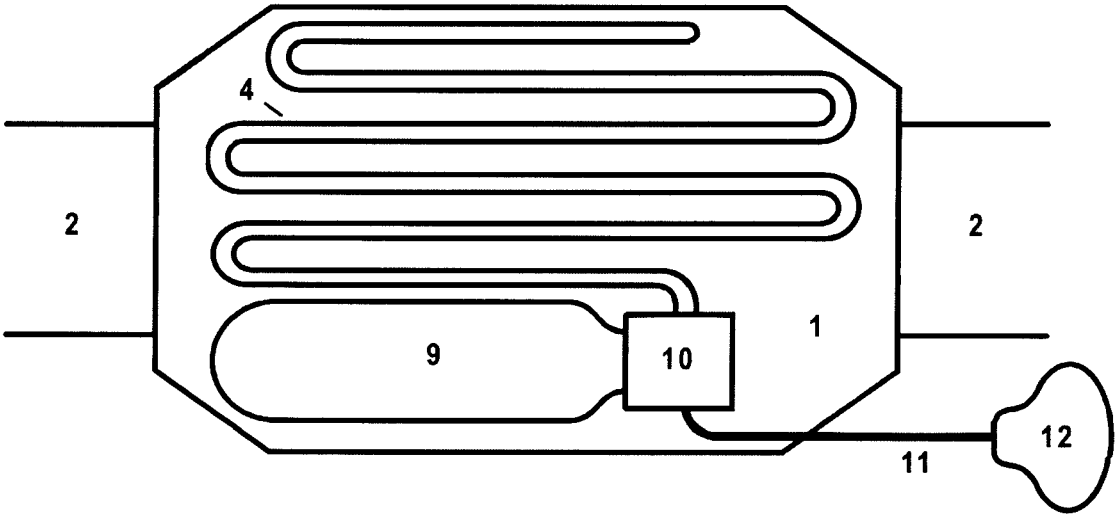
FIG. 4 is a cross-sectional view of one example of the stored bladder of the marker, recovery, and flotation device.

As can be seen in the embodiment of FIG. 4, the bladder 4 may be stored in an uninflated state at the enclosure 1. The bladder 4, in one embodiment, is connected to an inflator 10, which is fed by a gas cylinder 9. The gas cylinder may be activated either manually or automatically upon contact with the water to supply pressurized gas into the bladder 4. Additionally, an oral-inflation valve 13, as seen in FIG. 1, may be incorporated on the bladder in some cases to allow oral inflation of the bladder in the event that the pressurized cylinder 9 fails to inflate the bladders adequately, or if the user chooses to not expend a pressurized gas cylinder. The oral inflator can include a pressure relief valve to prevent an over-pressurized bladder.

The bladder 4 is typically made from a flaccid, impermeable material such as thermoplastic polyurethane (TPU) or PVC coated nylon fabric. The deployable tubes comprising the bladder 4 can be of any length. Enhanced visibility and recoverability may be obtained by increasing the lengths of the deployable tubes. Vertical height above the water would enable people aboard vessels with higher freeboard to more easily reach and secure the marker, recovery, and flotation device.

While the embodiments provided herein provide a triangular shaped marker, the present disclosure is not limited to this shape and the triangular shape is provided merely for illustration purposes. For example, in one embodiment the marker may be shaped like a teardrop. In other examples, the marker may be rectangular. In other examples, the marker may be oval. Other shapes could equally be used with the embodiments described herein.

Figure 7:
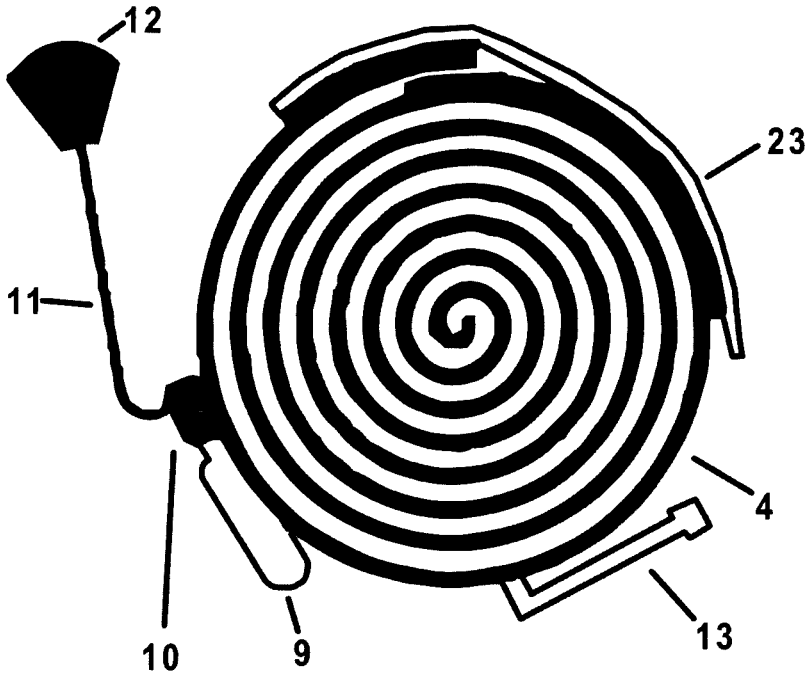
FIG. 7 is a cross-sectional view of the stored bladder of the marker, recovery and flotation device in another configuration.

As can be seen in FIG. 4 and in FIG. 7, the bladder 4, when stored, is folded back on itself one or more times, or rolled up or otherwise packed, so that it is contained in a secure package. The bladder 4 can be covered by a detachable panel 23 so that it is securely stored at the means of containment 1 when not in use. The detachable panel is typically a flap of material attached to the enclosure 1 and using hook and loop fastener, referred to as Velcro™, tabs that locate the panel and maintain it in situ, or burst zipper, or similar.

As can also be seen from FIG. 4, if deployment of the bladder 4 is desired, the pressurized gas contained within gas cylinder 9 is released by pulling cord 11 using handle 12, causing the bladder 4 to inflate. This may occur prior to immersion in the water or subsequent to immersion in the water depending upon when the user chooses to deploy the bladder 4.

Activation of the inflator 10 supplies pressurized gas to the interior of the bladder 4 causing the bladder 4 to begin inflation. If inflation is initiated while the bladder 4 is stored at the enclosure 1, initial inflation of the bladder 4 causes any covering panel to be released and the bladder 4 to extend outward. Continued inflation of the bladder 4 moves the top of bladder 4 progressively outward until it attains a deployed condition where it is fully pressurized and extends outward from the enclosure 1.

If necessary, additional inflation can be provided from the oral inflation valve 13 to ensure that the bladder 4 is fully inflated.

Alternatively, inflation may be initiated while the bladder 4 is not at the enclosure 1.

Further, in one alternative embodiment, rather than using cord 11, automatic inflation may be initiated based on a water sensor within enclosure 1.

Deflation of the bladder 4 may be accomplished using the oral inflation valve 13.

Figure 2:
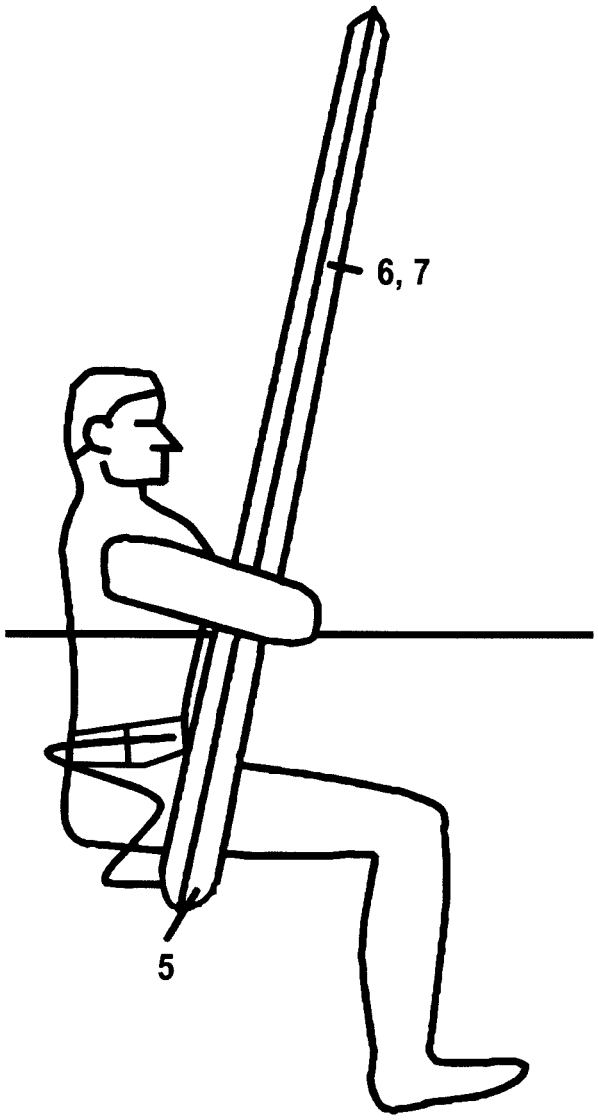
FIG. 2 is a side elevation showing the marker, recovery and flotation device in a deployed condition, with the user sitting on its lower crossbar.

FIG. 2 illustrates the user sitting atop elongate tube 5 of bladder 4, with first and second tubes 6 and 7 of bladder 4 rising along the right and left sides of the user. This raises the user's head above its position when not sitting atop elongate tube 5 of bladder 4, and increases the likelihood of waves passing under the user's head instead of over the user's head. The user is able to grasp first and second tubes 6 and 7 for stability in the water. The portion of bladder 4 above the water level also acts as a location marker.

Figure 3:
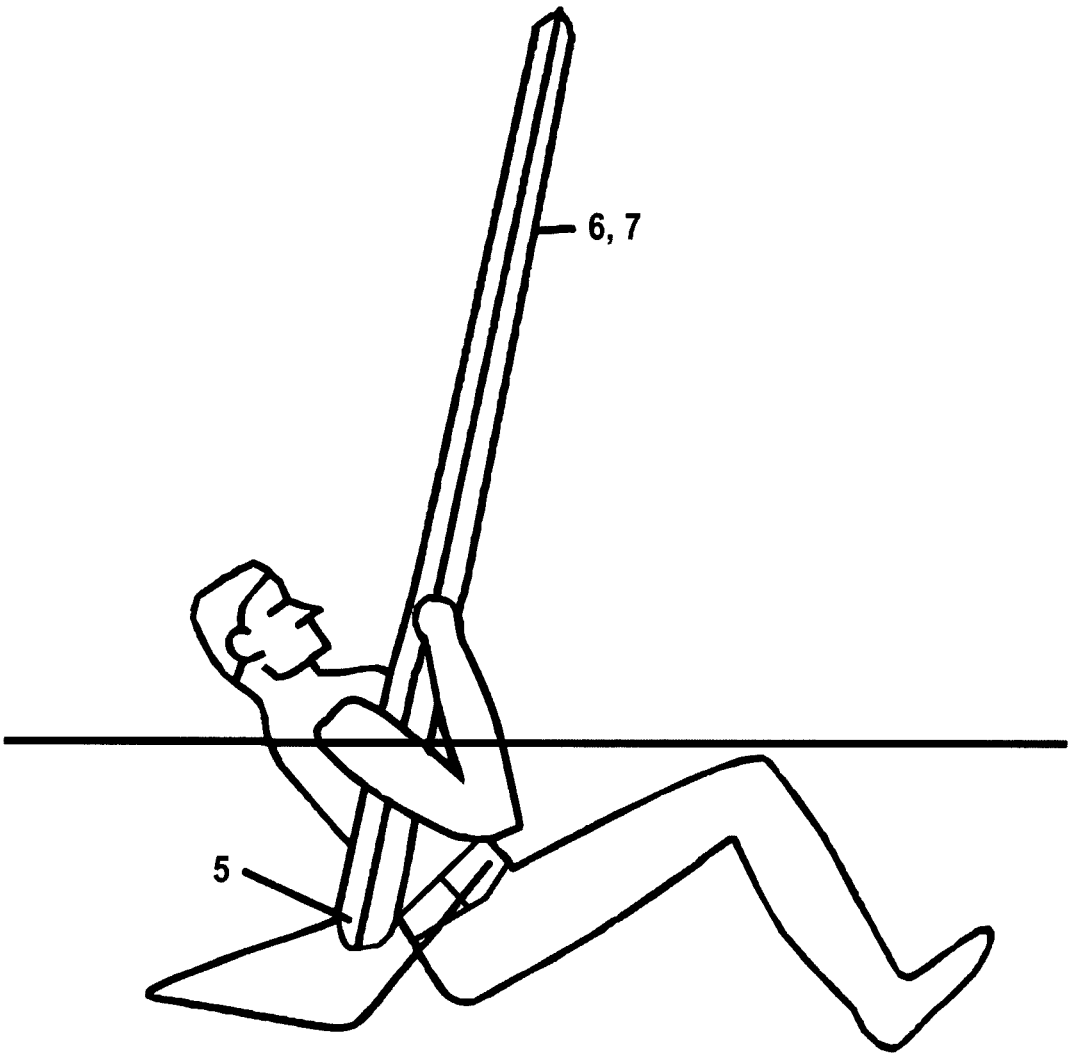
FIG. 3 is a side elevation showing the marker, recovery and flotation device in a deployed condition, with the device's lower crossbar behind the user's back.

FIG. 3 illustrates the user floating in water, with tube 5 of bladder 4 along the user's back. In this configuration, the submerged portion of bladder 4 provides the buoyancy function of a PFD, with the remaining portion of bladder 4 acting as a location marker. The bladder 4 may also act as a partial breakwater, helping to deflect or diffuse oncoming waves.

Figure 6:
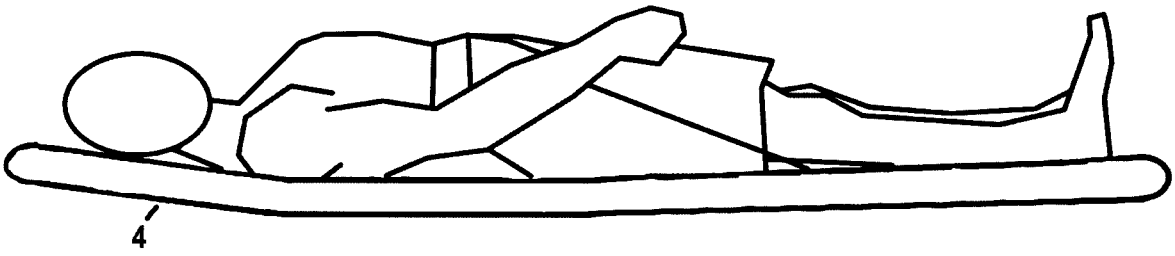
FIG. 6 is a side elevation showing the marker, recovery, and flotation device in a deployed condition, with the user lying on the floating device in a face-up position.

FIG. 6 illustrates the user being partly supported by the buoyancy of the deployed bladder 4, reducing the effects of hypothermia. This configuration of the deployed bladder, with the user either facing upwards or facing downwards, also allows the user to float over hazards such as coral reefs without injury in some situations where floating without the deployed bladder could cause injury. The bladder 4 may also be used as a swimming aid by users learning to swim, by physically disabled users, or by other users for any reason, in recreational or other settings.

Recovery of the user is facilitated by the link 8 which enables the user to be bodily lifted from the water. A rope, hook, or other lifting object may be attached to the closed loop formed by inflatable first and second upper tubes 6 and 7 and by link 8. Alternatively, link 16 may be used in place of link 8.

Thereafter the user, while having the bladder located around the user's torso, may be hoisted from the water and secured on board the rescue vessel, which could be a boat, helicopter or other vehicle. The hook, rope, or other means of hoisting could be lowered and secured to the bladder 4 without requiring a person from the rescue vessel to enter the water. Additionally, the first and second upper tubes 6 and 7 can form a ladder-like arrangement with elongate tube 5 and any additional links between tubes 6 and 7, and can be used as a ladder to board a nearby vessel or other structure such as a dock or non-marine structure.

FIG. 5 illustrates handles 17 and 18 on the bladder 4. Such handles may be optionally provided in some embodiments. Handles 17 and 18 may be used to grasp or control the bladder 4, or could be used as attachment points to pull or lift the bladder 4.

Various alternative arrangements may be utilized with the bladder 4. If necessary, a passive inflation device, such as a foam rubber, coil spring or mechanical linkage could be utilized.

Gas inflation may be through a pressurized gas inflator, for example using a carbon dioxide cylinder, a pressure reduction fitting attached to a Scuba air tank, or by other means.

The bladder 4 of the marker, recovery, and flotation device may be permanently attached to the enclosure 1, or be made to be fully detachable by providing releasable connectors, such as quick-release buckles, on the connection between the bladder 4 and the belt, harness or personal flotation device it is attached to. In this way an existing PFD may be retrofitted with the marker and recovery device, or the marker and recovery device replaced if necessary.

The bladder 4 may be left unattached to the user at any time including at inflation, or have one or more attachments of any length or means to the user. Other possible attachment locations include but are not limited to the user's arm, illustrated in FIG. 5 by enclosure 19 and connecting link 20, and the user's leg, illustrated by enclosure 21 and connecting link 22.

The bladder 4 can also be attached to two or more users simultaneously. It can also be attached to one or more points on the bladder 4. Two or more bladders could be connected in order to keep several users together.

Unattached or attached deployed bladders could be used by persons other than the person wearing the enclosure, in situations such as life guards rescuing swimmers.

Deployed or undeployed bladders could be thrown to persons in distress.

It will also be appreciated that ancillary equipment such as whistles, reflective tape and lights, and pouches for equipment such as cell phones and radios, may be incorporated into the marker, recovery, and flotation device. Radar-reflective shapes and materials may also be incorporated inside and outside the bladder.

It will also be appreciated that the bladder may be of any color or combination of colors, and of any size.

It will also be appreciated that the marker, recovery, and flotation device may be attached to any person, animal or object that may require marking and recovery, such as pet animals that fall into the water, or cargo containers that are swept into the water.

It will also be appreciated that the marker, recovery, and flotation device may be used in non-marine applications where visibility and rescue are needed, such as rescue from deep forests or from high rise balconies, rooftops or other locations. The device can be attached to a rope or line in order for the user to rappel up or down buildings, sides of ships or other natural or manmade objects.

It will also be appreciated that the marker, recovery, and flotation device may be worn in its undeployed condition by individuals in hazardous activities such as ice rescue or firefighting, to be deployed if prompt location identification and rescue of the user were to be needed.

In some embodiments, the diameter of elongate tube 5 may differ from first upper tube 6 and second upper tube 7. Thus the diameter of elongate tube 5 may be larger than tubes 6 or 7 to provide additional buoyancy in some cases, or may be smaller than tubes 6 or 7, for example to provide a more compact device in other cases.

The tubes may also have variable diameters or taper, for example a taper along tubes 6 and 7 to provide maximum buoyancy in the portions of tubes 6 and 7 near elongate tube 5, while saving mass and volume in the portions of tubes 6 and 7 that are more distal from tube 5.

Further, the cross section of tubes 5, 6 or 7 could be round in some embodiments, but may also be oval, obround, lenticular, semi-round, semi-oval, triangular, among other options.

The embodiments described herein are examples of structures, systems or methods having elements corresponding to elements of the techniques of this application. This written description may enable those skilled in the art to make and use embodiments having alternative elements that likewise correspond to the elements of the techniques of this application. The intended scope of the techniques of this application thus includes other structures, systems or methods that do not differ from the techniques of this application as described herein, and further includes other structures, systems or methods with insubstantial differences from the techniques of this application as described herein.

Also, techniques, systems, subsystems, and methods described and illustrated in the various implementations as discrete or separate may be combined or integrated with other systems, modules, techniques, or methods. Other items shown or discussed as coupled or directly coupled or communicating with each other may be indirectly coupled or communicating through some interface, device, or intermediate component, whether mechanically, or otherwise. Other examples of changes, substitutions, and alterations are ascertainable by one skilled in the art and may be made.

While the above detailed description has shown, described, and pointed out the fundamental novel features of the disclosure as applied to various implementations, it will be understood that various omissions, substitutions, and changes in the form and details of the system illustrated may be made by those skilled in the art.

The invention claimed is:

1. A marker and recovery device comprising:

a bladder configured to extend from an uninflated state to a deployed state, the bladder comprising:

an elongate tube configured to buoyantly support a user seated thereon when in the deployed state;

a first upper tube fluidly connected to the elongate tube at a first end of the elongate tube; and a second upper tube fluidly connected to the elongate tube at a second end of the elongate tube, the first upper tube and second upper tube joining to form a handle portion at the end of the elongate tube, wherein the first upper tube and the second upper tube are dimensioned to extend above a head of the user when in the deployed state and the user is seated on the elongate tube;

an enclosure configured to be secured to the user and house the bladder in the uninflated state therein; and an inflation mechanism to inflate the bladder to extend the bladder from the uninflated state to the deployed, wherein the bladder is detachable from the enclosure.

2. The device according to claim 1, further comprising a link between the first upper tube and second upper tube.

3. The device according to claim 2, wherein the link fluidly connects the first upper tube and second upper tube.

4. The device according to claim 2, wherein the link is comprised of a rope or webbing between the first upper tube and second upper tube.

5. The device according to claim 1, wherein the enclosure is adapted to be worn on the front of the torso of the user.

6. The device according to claim 1, wherein the enclosure is adapted to be worn on the rear of the torso of the user.

7. The device according to claim 1, wherein the enclosure is adapted to be worn on an arm of the user.

8. The device according to claim 1, wherein the enclosure is adapted to be worn on a leg of the user.

9. The device according to claim 1, wherein the inflation mechanism comprises a canister containing a compressed fluid.

10. The device according to claim 1, wherein the enclosure is part of a belt.

11. The device according to claim 1, wherein the enclosure is part of a flotation device.

12. The device according to claim 1, wherein said bladder is stored in an uninflated state using a detachable panel.

13. The device according to claim 1, wherein said bladder is formed from a flaccid, impermeable material.

14. The device according to claim 13, wherein said material is a thermoplastic polyurethane or PVC coated nylon fabric.

15. The device according to claim 1, wherein said bladder contains several air chambers.

16. The device according to claim 15, wherein each air chamber is fluidly connected to an inflation mechanism.

17. The device according to claim 1, wherein the first end of the elongate tube is distal to the second end of the elongate tube.

* * * * *